US008933618B2

(12) United States Patent
Sakakura

(10) Patent No.: US 8,933,618 B2
(45) Date of Patent: Jan. 13, 2015

(54) ELECTRODE-ATTACHED INSULATOR AND SPARK PLUG

(71) Applicant: NGK Spark Plug Co., Ltd., Nagoya-Shi, Aichi (JP)

(72) Inventor: Yasushi Sakakura, Ichinomiya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 14 days.

(21) Appl. No.: 13/855,014

(22) Filed: Apr. 2, 2013

(65) Prior Publication Data

US 2013/0264935 A1 Oct. 10, 2013

(30) Foreign Application Priority Data

Apr. 10, 2012 (JP) ..... 2012-088893

(51) Int. Cl.
*H01T 13/00* (2006.01)
*H01T 13/20* (2006.01)
*H01T 13/34* (2006.01)

(52) U.S. Cl.
CPC ..... *H01T 13/20* (2013.01); *H01T 13/34* (2013.01)
USPC ..... 313/145; 313/144

(58) Field of Classification Search
CPC ..... H01T 13/20; H01T 13/34
USPC ..... 313/144, 145
See application file for complete search history.

(56) References Cited

U.S. PATENT DOCUMENTS

| | | | | | |
|---|---|---|---|---|---|
| 2,525,536 | A | * | 10/1950 | Faatz et al. | 174/152 S |
| 2,526,933 | A | * | 10/1950 | Christie | 174/140 R |
| 2,680,432 | A | * | 6/1954 | Rand | 313/11.5 |
| 2,874,208 | A | * | 2/1959 | Pierce | 174/152 S |
| 3,139,553 | A | * | 6/1964 | Schwartzwalder | 313/144 |
| 3,229,032 | A | * | 1/1966 | Willis | 174/152 S |
| 3,328,621 | A | * | 6/1967 | Kesten et al. | 313/124 |
| 3,346,760 | A | * | 10/1967 | Jalbing et al. | 313/136 |
| 5,159,233 | A | * | 10/1992 | Sponseller et al. | 313/141 |
| 6,078,131 | A | * | 6/2000 | McMurray | 313/145 |
| 6,676,468 | B2 | | 1/2004 | Ishiguro et al. | 445/7 |
| 7,053,623 | B2 | * | 5/2006 | McMurray et al. | 324/402 |
| 7,825,573 | B2 | * | 11/2010 | Callahan et al. | 313/143 |

FOREIGN PATENT DOCUMENTS

| | | | |
|---|---|---|---|
| JP | 44-22563 | 9/1969 | |
| JP | 2-25195 | 2/1990 | H01T 13/52 |
| JP | 2-108289 | 8/1990 | H01T 13/20 |
| JP | 2002-141154 | 5/2002 | H01T 13/20 |

OTHER PUBLICATIONS

Office Action in corresponding Japanese patent application 2012-088893, dated Feb. 4, 2014 (English translation included).

* cited by examiner

*Primary Examiner* — Thomas A Hollweg
(74) *Attorney, Agent, or Firm* — Kusner & Jaffe

(57) ABSTRACT

An electrode-attached insulator having an insulator provided with an axial hole extending in the direction of an axis and a center electrode which is disposed on a distal-end side of the axial hole and has a front end portion that is exposed from a front end of the insulator. The electrode-attached insulator includes a locking member having a collar portion which is locked on a step portion. The center electrode and the locking member are joined together in the axial hole.

11 Claims, 8 Drawing Sheets

ELECTRODE-ATTACHED INSULATOR AND SPARK PLUG

FIELD OF THE INVENTION

The present invention relates to an electrode-attached insulator in which a center electrode is inserted through an insulator and a spark plug including the electrode-attached insulator.

BACKGROUND OF THE INVENTION

Spark plugs are used in combustion chambers of a combustion system such as an internal combustion engine to ignite fuel mixture. In general, a spark plug includes an electrode-attached insulator having an insulator that is made of a ceramic having insulation properties. The insulator is provided with an axial hole which extends in an axial direction and a center electrode that is inserted in the axial hole to be positioned on a front-end side of the axial hole such that a front end portion is exposed from a front end of the insulator. Additionally, the spark plug includes a cylindrical metal shell that is provided on an outer circumference of the electrode-attached insulator. Aground electrode is fixed to the metal shell and defines a gap between the center electrode and itself. Then, a predetermined voltage is applied to the gap to generate a spark discharge in the gap, whereby fuel mixture is ignited.

In general, the center electrode is inserted into the axial hole from a rear-end side opening and is held in place therein by a collar portion formed thereon at a rear-end side so as to protrude radially outwards, the collar portion being locked on a step portion provided on an inner circumference of the axial hole. Here, an outside diameter of a portion of the center electrode which is exposed from the front end of the insulator is made smaller than a minimum bore diameter of the axial hole so that the front end portion of the center electrode is exposed from the front end of the insulator.

Incidentally, the central electrode wears in association with generation of spark discharge, and the size of the gap is gradually increased. This increases gradually the voltage necessary to generate spark discharge (the discharge voltage), and when the discharge voltage is increased excessively, spark discharge cannot be generated (generally referred to as a "misfire" is called for).

Then, in order to realize an increase in durability, it is considered to increase the outside diameter of the portion of the central electrode which is exposed, i.e., extends, from the distal end of the insulator (the portion of the central electrode which define the gap). The outside diameter of the central electrode is increased so as to increase the volume of the central electrode to be worn until a misfire takes place. As an approach to increase the volume of the portion of the center electrode which is exposed from the insulator, an approach is considered in which an annular ring member is joined to an outer circumference of the front end portion of the center electrode after the center electrode has been inserted through the insulator (for example, refer to JP-A-2002-141154).

In this approach, however, since the ring member is joined to the center electrode after the center electrode has been inserted through the insulator, and the center electrode is inclined when the ring member is joined to the center electrode, a radial axis deviation tends to easily occur between the axis and a center line of the center electrode. Once the axis deviation occurs, there are concerns that a gap of a predetermined size cannot be formed any more or abnormal discharge creeping over the surface of the insulator (a so-called flashover) is easily generated between the center electrode and the metal shell.

In contrast to this, it is considered to increase the thickness of the center electrode so as to increase the volume of the portion of the center electrode which is exposed from the front end of the insulator. In this case, however, the minimum bore diameter of the axial hole needs to be increased to deal with the increase in the outside diameter of the center electrode. Because of this, the insulator has to be made thin, causing fears that a reduction in the withstand voltage performance of the insulator is called for.

SUMMARY OF THE INVENTION

The invention has been made in view of these situations, and an advantage of the present invention is an electrode-attached insulator which can increase the volume of a portion of a center electrode which is exposed from an insulator without resulting in an axis deviation between an axis and a center line of the center electrode or a reduction in withstand voltage performance to thereby increase the durability and a spark plug including the same insulator.

Aspects of the invention which are suitable for achieving the object will be described one by one below. Working effects specific to the aspects will be added thereto as required.

[1] According to a first aspect of the present invention, there is provided an electrode-attached insulator including:

an insulator having an axial hole which extends in the direction an axis; and a center electrode disposed in the axial hole on a front-end side of the axial hole wherein a front end portion is exposed from a front end of the insulator, said center electrode having a large diameter portion, said large diameter portion having an outside diameter that is larger than a minimum bore diameter of the axial hole and being disposed at a portion of the center electrode which is exposed, i.e., extends, from the front end of the insulator; and a locking member having a collar portion adapted to be locked on a step portion formed on an inner circumferential surface of the axial hole, wherein the center electrode and the locking member are joined together within the axial hole.

According to the first aspect of the invention, the large diameter portion having the outside diameter that is larger than the minimum bore diameter of the axial hole is provided at the portion of the center electrode which is exposed (extends) from the front end of the insulator. Consequently, it is possible to increase the volume of the center electrode to be worn, thereby making it possible to realize an increase in durability.

Incidentally, when the large diameter portion is provided at a front end portion of the center electrode, as has been described above, there are fears that the axis deviation or the reduction in withstand voltage performance takes place. In this respect, according to Configuration 1, the center electrode is joined to the locking member in the axial hole. Consequently, by inserting the center electrode into the axial hole from the front-end side opening and then joining the center electrode to the locking member which is disposed within the axial hole, the center electrode can be inserted to be held in place in the insulator. Namely, the large diameter portion is provided at the portion of the center electrode which is exposed from the front end of the insulator and then, the center electrode can be inserted to be held in place in the insulator. Because of this, it is possible to prevent the generation of axis deviation in an ensured fashion, which is feared to take place with a method in which the ring member is joined to the center electrode after it has been inserted through the insulator, thereby making it possible to align the center line of the center electrode with the axis with good accuracy. In addition, according to Configuration 1, the outside diameter of a portion of the center electrode which is inserted in the axial hole does not have to be increased in association with the formation of the large diameter portion. Consequently, the thickness of the insulator can be maintained sufficiently, thereby making it possible to realize a superior withstand voltage performance.

[2] According to a second aspect of the present invention, there is provided an electrode-attached insulator according to the first aspect, wherein the axial hole has:

a front-end side axial hole which is positioned further forward towards the front-end side in the direction of the axis than the step portion; and a rear-end side axial hole that lies adjacent to a rear-end side of the front-end side axial hole in the direction of the axis, said rear side axial hole having a bore diameter that is larger than a bore diameter of the front-end side axial hole, and at least part of a joining portion between the center electrode and the locking member is positioned in the rear-end side axial hole.

According to the second aspect of the invention, at least part of the joining portion between the center electrode and the locking member is positioned in the rear-end side axial hole that has a bore diameter that is larger than the bore diameter of the front-end side axial hole. Consequently, the joining area between the center electrode and the locking member can be made larger, thereby making it possible to increase the reliability in joining both the members together. In addition, the center electrode and the locking member can easily be joined together, whereby the workability can be increased.

In general, the insulator has a diametrically contracted portion of which an outside diameter is gradually contracted towards the front-end side in the axial direction, and this diametrically contracted portion is directly or indirectly locked on the metal shell. Then, heat at the front end portion of the insulator is drawn towards the metal shell by way of the diametrically contracted portion and the vicinity thereof. Consequently, the temperature of the insulator tends to become relatively high at a portion of the insulator which lies further forward towards the front-end side than the diametrically contracted portion and tends to become a relatively low temperature at a portion of the insulator which lies further rearward towards the rear-end side than the diametrically contracted portion.

In view of this, the diametrically contracted portion is preferably provided further forward towards the front-end side in the axial direction than the step portion (that is, a front end portion of the rear-end side axial hole). As this occurs, the temperature of an interior of the rear-end side axial hole which is positioned further rearward towards the rear-end side than the diametrically contracted portion can be reduced to a relatively low temperature. Consequently, the quantity of heat received by the joining portion which is positioned in the rear-end side axial hole (including the step portion) can be reduced. As a result, the reliability in joining the center electrode and the locking member can be increased further.

[3] According to a third aspect of the present invention, there is provided an electrode-attached insulator according to the first or second aspect, wherein a sealing member which fixes the insulator and the locking member together is provided in the axial hole, and the center electrode is in contact with the sealing member.

According to the third aspect of the invention, the center electrode is in contact with the sealing member which fixes the locking member and the insulator together. Consequently, the center electrode can be fixed to the insulator in a more ensured fashion. As a result, the axis and the center line of the center electrode can be kept aligned accurately with each other over a long period of time.

[4] According to a fourth aspect of the present invention, there is provided an electrode-attached insulator according to any of the first to third aspects, wherein the large diameter portion is in contact with the insulator.

According to the fourth aspect of the invention, by bringing the large diameter portion into contact with the insulator, the relative position of the center electrode to the insulator in the axial direction can be determined as a matter of course. Consequently, it becomes possible to prevent the offset of the center electrode in the axial direction in a more ensured fashion. As a result, the gap can be provided in a desired size and in a desired position more easily.

It should be noted that the outside diameter of the large diameter portion may differ along the axial direction as long as the outside diameter is larger than the minimum bore diameter of the axial hole. Consequently, for example, the large diameter portion may be made up of a first large diameter portion and a second large diameter portion that is positioned further rearward towards the rear-end side than the first large diameter portion and which has an outside diameter smaller than that of the first large diameter portion, and the second large diameter portion may be brought into contact with the insulator.

[5] According to a fifth aspect of the present invention, there is provided an electrode-attached insulator according to any of the first to fourth aspects, wherein the insulator has a diametrically expanded portion where the axial hole is diametrically expanded towards the front-end side in the direction of the axis at the front end thereof, and the large diameter portion is locked on the diametrically expanded portion.

According to the fifth aspect of the invention, by bringing the large diameter portion into contact with the diametrically expanded portion, the relative position of the center electrode to the insulator in the axial direction can be determined as a matter of course. Consequently, it becomes possible to prevent the offset of the center electrode in the axial direction in a more ensured fashion, and the gap can be provided in a desired size and in a desired position more easily.

By locking the large diameter portion on the diametrically expanded portion, an axial pressure can be applied to the large diameter portion. Consequently, the center line of the center electrode can be aligned with the axis with better accuracy.

[6] According to a sixth aspect of the present invention, there is provided an electrode-attached insulator according to any of the first to fifth aspects, wherein the center electrode and the locking member are screw joined together.

According to the sixth aspect of the invention, the center electrode and the locking member are screw joined together. Consequently, not only can the center electrode and the locking member be joined together easily, but also superior reliability in joining them together can be realized.

[7] According to a seventh aspect of the present invention, there is provided an electrode-attached insulator according to the sixth aspect, wherein an electrode rotation restricting portion for restricting its relative rotation to the locking member is provided at a rear end portion of the center electrode.

According to the seventh aspect of the invention, the relative rotation of the center electrode to the locking member can be restricted by the electrode rotation restricting portion provided at the rear end portion of the center electrode. Consequently, the screw joint between the center electrode and the locking member can be prevented from being loosened in an ensured fashion, and hence, the reliability in joining them together can be increased further.

[8] According to an eighth aspect of the present invention, there is provided an electrode-attached insulator according to any of the first to seventh aspects, wherein a locking member rotation restricting portion for restricting its relative rotation to the insulator is provided on the locking member.

According to the eighth aspect of the invention, the relative rotation of the locking member to the insulator can be restricted by the locking member rotation restricting portion provided on the locking member. Consequently, the contact state between the locking member and the insulator (the step portion) can be stabilized, whereby heat received by the center electrode can be conducted to the insulator via the locking member with good efficiency. As a result, the resistance to wear of the center electrode can be increased, thereby making it possible to realize a further increase in durability.

In addition, by stabilizing the contact state between the locking member and the insulator (the step portion), it is possible to realize an increase in gastightness between the locking member and the insulator (the axial hole).

Further, when the center electrode and the locking member are screw joined together, by making use of the locking member rotation restricting portion, the center electrode and the locking member can easily be screw joined together.

[9] According to a ninth aspect of the present invention, there is provided an electrode-attached insulator according to any of the first to eighth aspects, wherein a sealing member for fixing the insulator and the locking member together is provided in the axial hole, and the rear end portion of the center electrode projects further rearward towards the rear-end side in the direction of the axis than a rear end of the locking member to thereby be in contact with the sealing member.

According to the ninth aspect of the invention, the contact area of the center electrode with the sealing member can be increased. Consequently, the securing properties of the center electrode to the insulator can be increased further. Additionally, when the center electrode and the locking member are screw joined together, the loosening of the screw joint between the center electrode and the locking member can be prevented in a more ensured fashion, thereby making it possible to increase further the reliability in joining the center electrode and the locking member together.

[10] According to a tenth aspect of the present invention, there is provided an electrode-attached insulator according to the third or ninth aspect, wherein the sealing member is a glass seal containing a glass component.

According to the tenth aspect of the invention, the sealing member is made up of the glass seal which contains the glass component. Consequently, the securing properties of the center electrode to the insulator can be increased further.

[11] According to an eleventh aspect of the present invention, there is provided a spark plug including:

the electrode-attached insulator according to any of the first to tenth aspects;

a cylindrical metal shell provided on an outer circumference of the electrode-attached insulator; and a ground electrode configured to define a gap between the center electrode and itself.

According to the eleventh aspect of the invention, the same working effects as those provided by the first aspect of the invention are basically provided.

[12] According to a twelfth aspect of the present invention, there is provided a spark plug according to the eleventh aspect, wherein the gap is defined between a side circumferential surface of the large diameter portion and the ground electrode.

As types of spark plugs, there are known a type of spark plug in which a spark discharge is generated substantially along the axial direction between a front end face of a center electrode and a ground electrode (a so-called parallel electrode type spark plug) and a type of spark plug in which a spark discharge is generated in a direction which intersects the axial direction between a side circumferential surface of a center electrode and a ground electrode (a so-called horizontal discharge type or oblique discharge type spark plug). Here, in the horizontal discharge or oblique discharge type spark plug, when axis deviation is generated between the axis and the center line of the center electrode, even in the event that the axis deviation is minute, the size of the gap tends to be changed largely. In other words, in the horizontal discharge or oblique discharge type spark plug, the center line of the center electrode is required to be aligned with the axis with higher accuracy.

In a spark plug according to the twelfth aspect of the invention, the gap is defined between the side circumferential surface of the large diameter portion and the ground electrode, and there are fears that the size of the gap is changed remarkably in association with the occurrence of axis deviation. However, by using the electrode-attached insulator according to the first aspect and the like, the center line of the center electrode can be aligned with the axis with high accuracy, whereby the fears can be dismissed. In other words, the electrode-attached insulator according to the first aspect and the like is particularly advantageous when used in a spark plug in which a gap is defined between a side circumferential surface of a large diameter portion and a ground electrode.

DETAILED DESCRIPTION OF THE INVENTION

Figure 1:
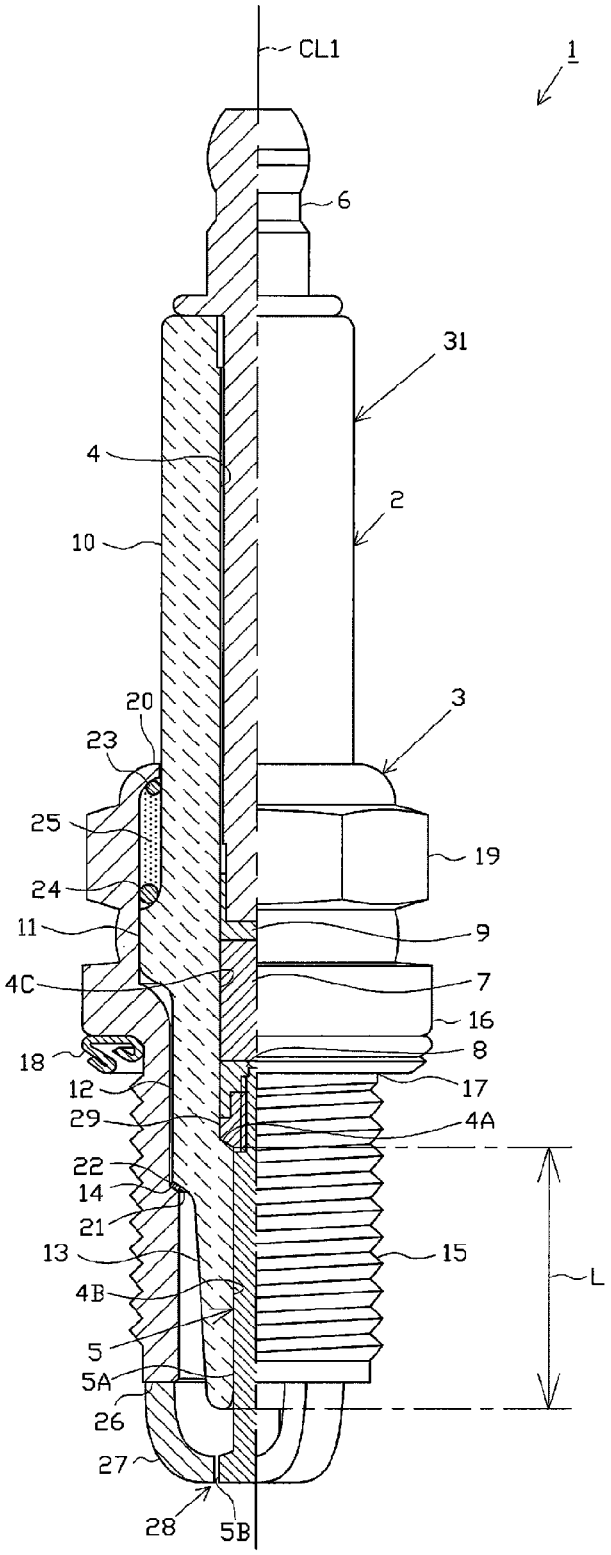
FIG. 1 is a partially cutaway front view showing the configuration of a spark plug.

Hereinafter, an embodiment of the invention will be described by reference to the drawings. FIG. 1 is a partially cutaway front view of a spark plug 1. It should be noted that in FIG. 1, the description will be made on the understanding that the direction of an axis CL1 of the spark plug 1 is referred to as a vertical direction in the figure and that a lower side of the spark plug 1 is referred to a front-end side, while an upper side as a rear-end side.

The spark plug 1 includes an electrode-attached insulator 31 having an insulator 2 and a center electrode 5, a cylindrical metal shell 3 which holds the electrode-attached insulator 31, and a ground electrode 27.

The insulator 2 has a cylindrical shape and is formed by calcining a ceramic having insulation properties such as alumina. When looking at the insulator 2 externally, the insulator 2 includes a rear-end side body portion 10 which is formed on a rear-end side. A protuberant portion 11 is formed so as to protrude radially outwards in a position lying further forward towards a front-end side than the rear-end side body portion 10, and a middle body portion 12 is formed smaller in diameter than the protuberant portion 11 in a position lying further forward towards the front-end side than the protuberant portion 11. A nose portion 13 is formed smaller in diameter than the middle body portion 12 in a position lying further forward towards the front-end side than the middle body portion 12. The protuberant or large diameter portion 11, the middle body portion 12 and most of the nose portion 13 of the insulator 2 are accommodated in an interior of the metal shell 3. Further, a diametrically contracted portion 14, of which an outside diameter is decreased towards the front-end side along the direction of the axis CL1, is formed between the middle body portion 12 and the nose portion 13 so as to lie adjacent to a rear-end side of the nose portion 13 in the direction of the axis CL1. Then, the insulator 2 is locked on the metal shell 3 at the diametrically contracted portion 14. In this embodiment, the diametrically contracted portion 14 is provided further forward towards the front-end side in the direction of the axis CL1, than a step portion 4A, which will be described later. In addition, a thickness of a rear end portion of the nose portion 13 is equal to or larger than at least a predetermined (for example, 1.0 mm), so that the insulator 2 is allowed to have a good withstand voltage performance.

Further, an axial hole 4 is formed in the insulator 2 so as to extend therethrough along the axis CL1, and the center electrode 5 is inserted in the axial hole 4 to be positioned on a front-end side of the same hole. The center electrode 5 is formed mainly of a metal containing nickel (Ni) as a main constituent, and a front end portion thereof is exposed from a front end of the insulator 2. It should be noted that a configuration may be adopted in which an inner layer made of a metal having superior heat conductivity (for example, copper, copper alloy or pure Ni) is provided in an interior of the center electrode 5 so as to realize an increase in durability of the center electrode 5.

In addition, a terminal electrode 6 is inserted to be fixedly held in place in the axial hole 4 to lie on a rear-end side of the axial hole 4 in such a state that the terminal electrode 6 projects from a rear end of the insulator 2.

Further, a cylindrical resistor 7 is provided between the center electrode 5 and the terminal electrode 6 in the axial hole 4. In addition, in the axial hole 4, the resistor 7 is held by a conductive glass seal 8 (corresponding to a "sealing member" of the invention) and a conductive glass seal 9 therebetween, both the glass seals containing a glass component. The center electrode 5 and the terminal electrode 6 are electrically connected via the resistor 7 and the glass seals 8, 9. Additionally, the insulator 2 and a locking member 29, which will be described later, are fixed together by the glass seal 8.

In addition, the metal shell 3 is formed of metal such as low-carbon steel and has a cylindrical shape which extends in the direction of the axis CL1. A thread portion 15 is formed on an outer circumferential surface of the metal shell 3 for mounting the spark plug 1 in a mounting hole in a combustion system (for example, an internal combustion engine). Further, a collar-shaped seat portion 16, which projects radially outwards, is formed on an outer circumferential surface at a rear-end side of the thread portion 15. A ring-shaped gasket 18 is fitted in a thread groove 17 at a rear end of the thread portion 15. In addition, a tool engagement portion 19 having a hexagonal cross section is provided in a position lying further rearward towards the rear-end side than the seat portion 16 so that a tool such as a wrench is brought into engagement therewith in mounting the spark plug 1 in the combustion system. Additionally, a crimping portion 20 is provided in a position lying further rearward towards the rear-end side than the tool engagement portion 19, and this crimping portion 20 is bent radially inwards so as to hold the insulator 2.

Further, a taper portion 21 is provided on an inner circumferential surface of the metal shell 3 where a bore diameter of the metal shell 3 is decreased towards the front-end side in the direction of the axis CL1. Then, the insulator 2 is inserted into the metal shell 3 from a rear-end side of the metal shell 3 towards a front-end side thereof. The insulator 2 is then fixed to the metal shell 3 by crimping a rear-end side opening portion of the metal shell 3 radially inwards, that is, by forming the crimping portion 20 in such a state that the diametrically contracted portion 14 of the insulator 2 is locked on the taper portion 21 of the metal shell 3. It should be noted that a ring-shaped plate packing 22 is interposed between the diametrically contracted portion 14 and the taper portion 21. By doing so, the gastightness in a combustion chamber is maintained, so that fuel gas that enters a gap between a rear end portion of the nose portion 13 of the insulator 2 which is exposed to an interior of the combustion chamber and the inner circumferential surface of the metal shell 3 is prevented from leaking to the outside of the combustion chamber.

Further, in order to ensure the gastightness realized by crimping more completely, annular ring members 23, 24 are interposed between the metal shell 3 and the insulator 2 on the rear-end side of the metal shell 3, and powder of talc 25 is filled between the ring members 23, 24. Namely, the metal shell 3 holds the insulator 2 via the plate packing 22, the ring members 23, 24 and the talc 25.

A plurality of ground electrodes 27 (three in this embodiment), which each are made of an Ni alloy, are joined to a front end portion 26 of the metal shell 3. The ground electrodes 27 are provided along a circumferential direction of the metal shell 3 at equal intervals, and the ground electrodes 27 are bent back so that distal end faces thereof face oppositely a side circumferential surface of the center electrode 5. A configuration may be adopted in which an inner layer of a metal (for example, copper or a copper alloy) having superior heat conductivity is provided in an interior of each ground electrode 27 so as to realize an increase in durability of the ground electrode 27.

In addition, a gap 28 is formed between a front end portion of the center electrode 5 and the distal end face of each of the ground electrodes 27, and a spark discharge is generated in this gap 28 in a direction which intersects the axis CL1 substantially at right angles. In this embodiment, the gap 28 is formed between a side circumferential surface of a large diameter portion 5B, which will be described later, and the distal end face of each of the ground electrodes 27.

Next, the configurations of the axial hole 4, the center electrode 5 that is inserted into the axial hole 4 and the locking member 29 that is joined to the center electrode 5 will be described.

In this embodiment, the axial hole 4 includes the step portion 4A where the bore diameter of the axial hole 4 is decreased towards the front-end side in the direction of the axis CL1 and a front-end side axial hole 4B which is positioned further forward towards the front-end side in the direction of the axis CL1 than the step portion 4A. Further, the axial hole 4 includes a rear-end side axial hole 4C that lies adjacent to a rear-end side of the front-end side axial hole 4B in the direction of the axis CL1 and at a front end portion of which the step portion 4A is formed. A bore diameter of the rear-end side axial hole 4C is made larger than a bore diameter of the front-end side axial hole 4B. In this embodiment, a distance L extending from a front end of the step portion 4A to the front end of the insulator 2 along the axis CL1 is equal to or larger than 15 mm.

Figure 2:
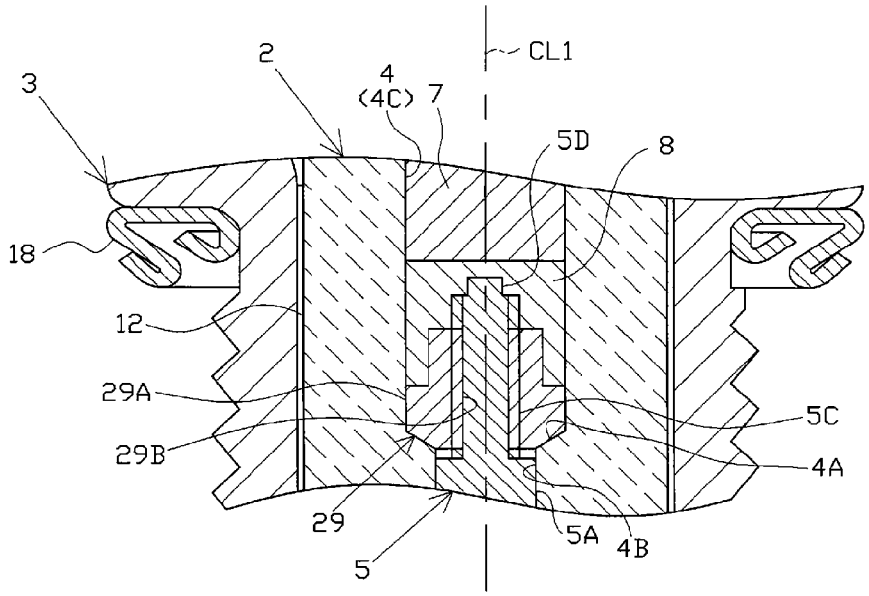
FIG. 2 is a partial enlarged sectional view showing the configuration of a locking member and a center electrode.
Figure 4A:
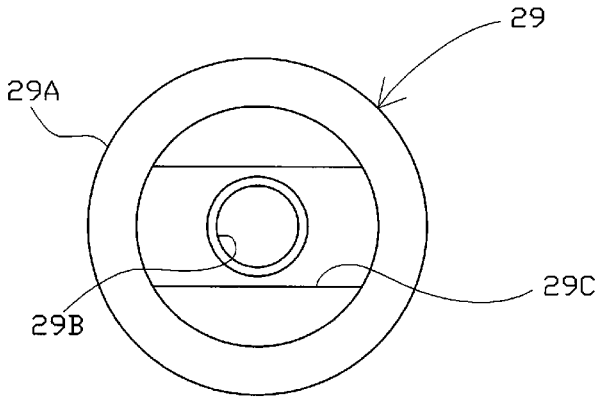
FIG. 4A is a plan view showing the configuration of the locking member.
Figure 4B:
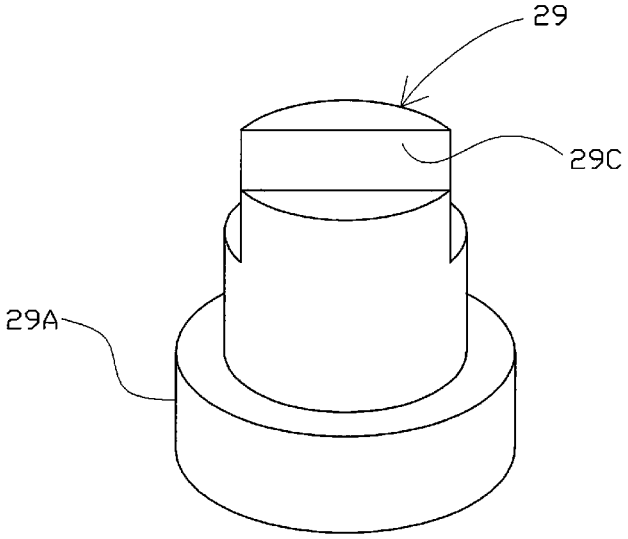
FIG. 4B is a perspective view showing the configuration of the locking member.

Further, as shown in FIG. 2, a locking member 29A is provided in the axial hole 4 (the rear-end side axial hole 4C), and the locking member 29A has a collar portion 29A which is locked on the step portion 4A. The locking member 29A has a cylindrical shape and includes an internal thread portion 29B on an inner circumference thereof. In addition, as shown in FIGS. 4A, 4B, the locking member 29A includes a groove portion (corresponding to a "locking member rotation restricting portion") 29C which extends along a radial direction at a rear end portion thereof. Then, the relative rotation of the locking member 29 to the insulator 2 is restricted by the glass seal 8 entering the groove portion 29C.

Figure 3A:
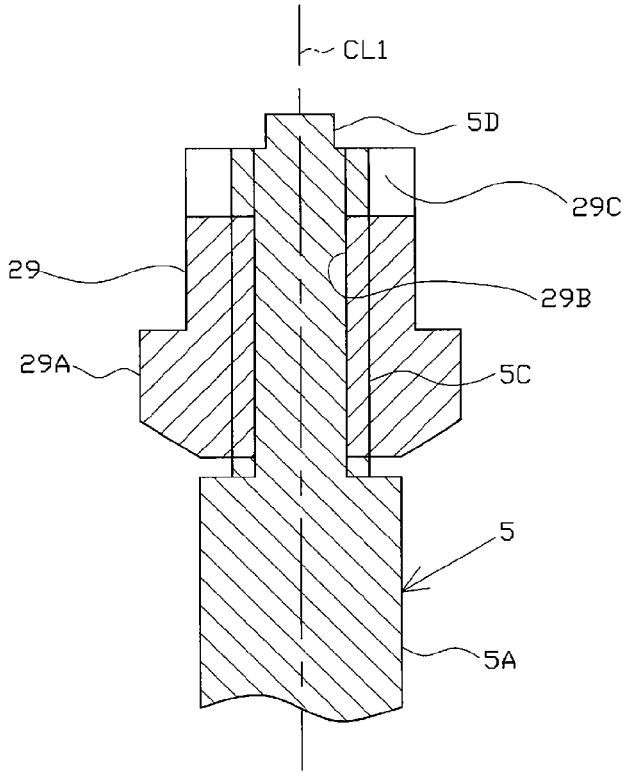
FIG. 3A is a sectional view showing the center electrode joined to the locking member.

Returning to FIG. 1, the center electrode 5 includes a main body portion 5A which is inserted into the front-end side axial hole 4B and the collar-shape large diameter portion 5B that is exposed from the front end of the insulator 2 and of which an outside diameter is larger than a minimum bore diameter of the axial hole 4. Further, as shown in FIGS. 2 and 3A, the center electrode 5 includes an external thread portion 5C that extends from a rear end of the main body portion 5 towards the rear-end side, which is smaller in diameter than the main body portion 5A and which can screwed into the internal thread portion 29B. Then, by the external thread portion 5C being screwed into the internal thread portion 29B of the locking member 29, the center electrode 5 and the locking member 29 are screw joined together in the axial hole 4. In this embodiment, at least part of the joining portion between the center electrode 5 and the locking member 29 is positioned in the rear-end side axial hole 4C. In addition, the large diameter portion 5B is not such as to be provided on the main body portion 5A by joining a separate member to the main body portion 5A, and hence, the main body portion 5A and the large diameter portion 5B are formed integrally of a single metal member.

Figure 3B:
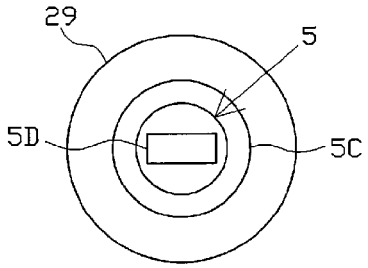
FIG. 3B is a plan view showing the center electrode joined to the locking member.

In addition, as shown in FIGS. 3A, 3B, a projecting portion (corresponding to an "electrode rotation restricting portion" in the invention) 5D is provided at a rearmost end portion of the center electrode 5 so as to project towards the rear-end side in the direction of the axis CL1. In this embodiment, the projecting portion 5D has a flat plate shape which extends along the radial direction and projects further rearward towards the rear-end side in the direction of the axis CL1 than a rear end of the locking member 29. Then, the projecting portion 5D is in contact with the glass seal 8 in such a state that the projecting portion 5D is embedded in the glass seal 8. By dong so, the relative rotation of the center electrode 5 to the glass seal 8 and hence to the locking member 29 which is fixed to the glass seal 8 is restricted.

Next, a manufacturing method of the spark plug 1 configured as has been described heretofore will be described.

Firstly, the metal shell 3 is worked in advance. Namely, a general shape is formed by cold forging a cylindrical metallic material (for example, an iron-based material or a stainless steel material), and a through hole is formed therethrough. Thereafter, an external shape is given to the metallic material by cutting to thereby obtain a metal shell intermediate product.

Following this, the straight rod-shaped ground electrodes 27 which are each made of the Ni alloy are welded to a front end face of the metal shell intermediate product through resistance welding. In welding, a so-called "welding droop" is generated, and hence, after this "welding droop" is removed the thread portion 15 is formed by rolling at a predetermined location of the metal shell intermediate product. By doing so, the metal shell 3 having the ground electrodes 27 welded thereto is obtained. Then, the metal shell 3 having the ground electrodes 27 welded thereto is plated with zinc or nickel. Further, a chromate treatment may be applied to the surface of the zinc or nickel plated metal shell 3 so as to increase the resistance to corrosion.

Separately from the metal shell 3, the insulator 2 is molded in advance. Namely, a molding granular material is prepared by using a powder material which contains alumina as a main constituent and a binder. The molding granular material is rubber pressed to obtain a cylindrical molded product. Then, the cylindrical molded product is cut to be shaped and is then calcined in a calcination oven, whereby the insulator 2 is obtained.

In addition, separately from the metal shell 3 and the insulator 2, an Ni alloy is forged or rolled to produce the center electrode 5 having the large diameter portion 5B and the external thread portion 5C in advance.

Following this, the locking member 29, which is prepared in advance, is inserted into the axial hole 4 from the rear-end side thereof so that the locking member 29 is rested on the step portion 4A in the axial hole 4. Then, the center electrode 5 is inserted into the axial hole 4 from the front-end side thereof, and the external thread portion 5C of the center electrode 5 is screwed into the internal thread portion 29B of the locking member 29 in such a state that the relative rotation of the locking member 29 to the insulator 2 is restricted. As this occurs, the front end portion (the large diameter portion 5B) of the center electrode 5 is disposed in a predetermined relative position to the front end portion of the insulator 2 by adjusting the amount by which the external thread portion 5C is screwed into the internal thread portion 29B.

Next, the insulator 2, the center electrode 5, the locking member 29, the resistor 7 and the terminal electrode 6 are sealed and fixed together by the glass seals 8, 9. In general, borosilicate glass is mixed with metal powder to prepare the glass seals 8, 9, and the mixture so prepared is injected into the axial hole 4 in the insulator 2 so as to hold the resistor 7 from top and bottom thereof. Thereafter, the mixture is heated in the calcination oven while being pressed from the rear by the terminal electrode 6 and is then calcined solidly. As this occurs, the projecting portion 5D of the center electrode 5 is embedded in the glass seal 8, and the glass seal 8 enters in the groove portion 29C in the locking member 29.

Thereafter, the insulator 2 which includes the center electrode 5, the locking member 29 and the terminal electrode 6 is fixed to the metal shell 3 which includes the ground electrodes 27. To describe this in greater detail, the insulator 2 is inserted into the metal shell 3 and the rear-end side opening portion of the metal shell 3 which is formed relatively thin is then crimped radially inwards, that is, the crimping portion 20 is formed, whereby the insulator 2 and the metal shell 3 are fixed together.

Lastly, the ground electrodes 27 are bent towards the center electrode 5, and the size of the gaps 28 defined between the side circumferential surface of the large diameter portion 5B and the distal end faces of the ground electrodes 27 is adjusted, whereby the spark plug 1 is obtained.

Thus, as has been described heretofore, according to the embodiment of the invention, the large diameter portion 5B, of which the outside diameter is larger than the minimum bore diameter of the axial hole 4, is provided at the portion of the center electrode 5 which is exposed from the front end of the insulator 2. Consequently, the volume of the center electrode 5 to be worn until a misfire takes place can be increased, thereby making it possible to realize an increase in durability of the spark plug 1.

Further, in the embodiment, the center electrode 5 is inserted into the axial hole 4 from a front-end side opening and is then joined to the locking member 29 in the axial hole 4. Namely, the large diameter portion 5B is provided at the portion of the center electrode 5 which is exposed from the front end of the insulator 2, and the center electrode 5 is then inserted into the insulator 2. Because of this, although there may be concern that axis deviation may take place when the large diameter portion is provided on the center electrode after the center electrode has been inserted into the insulator, the occurrence of axis deviation can be suppressed in a more ensured fashion, thereby making it possible to align the center line of the center electrode 5 with the axis CL1 with good accuracy. Additionally, according to the embodiment, the outside diameter of the portion of the center electrode 5 which is inserted into the axial hole 4 does not have to be increased in association with the formation of the large diameter portion 5B. Consequently, the thickness of the insulator 2 (the rear end portion of the nose portion 13) can be maintained sufficiently, thereby making it possible to realize the superior withstand voltage performance.

In addition, in the embodiment, at least part of the joining portion between the center electrode 5 and the locking member 29 is positioned in the rear-end side axial hole 4C. Consequently, the joining area between the center electrode 5 and the locking member 29 can be increased, thereby making it possible to increase the reliability in joining both the members together. Additionally, the joining of the center electrode 5 and the locking member 29 is facilitated, thereby making it possible to increase the workability.

Further, the diametrically contracted portion 14 is provided in the position lying further forward towards the front-end side in the direction of the axis CL1 than the step portion 4A (that is, the front end portion of the rear-end side axial hole 4C), and the temperature of the interior of the rear-end side axial hole 4C which lies further rearward towards the rear-end side than the diametrically contracted portion 14 is decreased to the relatively low temperature. Consequently, the quantity of heat received by the joining portion between the center electrode 5 and the locking member 29 which is positioned in the rear-end side axial hole 4C can be reduced. As a result, the reliability in joining the center electrode 5 and the locking member 29 can be increased further.

In addition, the rear end portion (the projecting portion 5D) of the center electrode 5 projects further rewards towards the rear-end side in the direction of the axis CL1 than the rear end of the locking member 29 to thereby be in contact with the glass seal 8. Consequently, the center electrode 5 can be secured to the insulator 2 in a more ensured fashion. As a result, the center line of the center electrode 5 can be kept aligned with the axis CL1 with good accuracy over a long period of time.

Further, the center electrode 5 and the locking member 29 are screw joined together. Consequently, not only can the center electrode 5 and the locking member 29 be joined together easily, but also the superior reliability in joining both the members together can be realized. Further, the relative position of the center electrode 5 to the insulator 2 in the direction of the axis CL1 can be adjusted by changing the amount by which the center electrode 5 (the external thread portion 5C) is screwed into the locking member 29 (the internal thread portion 29B), whereby it becomes possible to prevent the occurrence of variation in the relative position of the center electrode 5 to the insulator 2.

In addition, in the embodiment, the relative rotation of the center electrode 5 to the locking member 29 is restricted by allowing the projecting portion 5D provided at the rear end portion of the center electrode 5 to be embedded in the glass seal 8. Consequently, it is possible to prevent the loosening of the screw joint between the center electrode 5 and the locking member 29 in a more ensured fashion, thereby making it possible to increase further the reliability in joining both the members together.

Additionally, the relative rotation of the locking member 29 to the insulator 2 is restricted by allowing the glass seal 8 to enter the groove portion 29C provided in the locking member 29. Consequently, the contact state between the locking member 29 and the insulator 2 (the step portion 4A) can be stabilized, and therefore, heat received by the center electrode 5 can be conducted with good efficiency to the insulator 2 by way of the locking member 29. As a result, the resistance to wear of the center electrode 5 can be increased, thereby making it possible to realize a further increase in durability of the spark plug 1. In addition, by stabilizing the contact state between the locking member 29 and the insulator 2 (the step portion 4A), it is possible to realize an increase in gastightness between the locking member 29 and the insulator 2 (the axial hole 4).

As in the embodiment, when the distance L is relatively large (equal to or larger than 15 mm), even in the event that the center electrode 5 is inclined slightly, the center line of the center electrode 5 tends to deviate largely from the axis CL1 at the distal end portion of the spark plug 1 (the electrode-attached insulator 31). Additionally, as in the embodiment, when the gaps 28 are defined between the side circumferential surface of the large diameter portion 5B and the ground electrodes 27, the size of the gaps 28 tends to be changed remarkably in association with the occurrence of axis deviation. According to the embodiment, however, the center line of the center electrode 5 can be aligned with the axis CL1 with good accuracy. In other words, the invention is particularly advantageous when applied to the spark plug 1 (the electrode-attached insulator 31) in which the distance L is equal to or larger than 15 mm and the gaps 28 are defined between the side circumferential surface of the large diameter portion 5B and the ground electrodes 27.

The invention is not limited to the embodiments and hence, may be carried out as below. The invention can, of course, be carried out based on other application examples or modified examples than those illustrated below.

Figure 5:
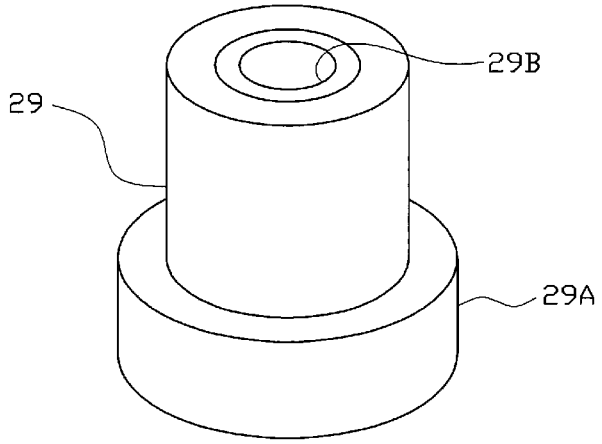
FIG. 5 is a perspective view showing the configuration of a locking member according to a second embodiment of the invention.

(a) In the embodiment, while the groove portion 29C is provided as the locking member rotation restricting portion, the locking member rotation restricting portion should be such as to restrict the relative rotation of the locking member 29 to the insulator 2, and hence, there is imposed no specific limitation on the configuration of the locking member rotation restricting portion. Consequently, for example, as the locking member rotation restricting portion, a configuration may be adopted in which a plurality of projecting portions are provided so as to be aligned at irregular intervals along a circumferential direction on the axis CL1 while projecting towards the rear-end side in the direction of the axis CL1 and the projecting portions are allowed to be embedded in the glass seal 8 to thereby restrict the relative rotation of the locking member 29 to the insulator 2. Additionally, as the locking member rotation restricting portion, a configuration may be adopted in which a plurality of grooves are provided on an outer circumference of the locking member 29 so as to extend in the direction of the axis CL1 and by allowing the glass seal 8 to enter the grooves, the relative rotation of the locking member 29 to the insulator 2 is restricted. It should be noted that as shown in FIG. 5, the locking member rotation restricting portion (the groove portion 29C) may be omitted.

Figure 6:
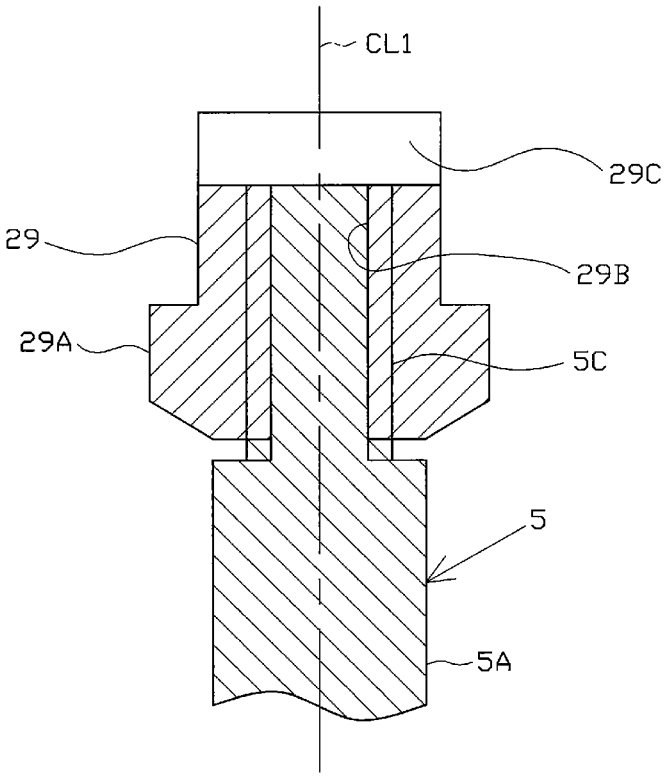
FIG. 6 is a sectional view showing the configuration of a center electrode and the like according to the second embodiment of the invention.

(b) In the embodiment, while the projecting portion 5D which extend along the radial direction is provided as the electrode rotation restricting portion, the electrode rotation restricting portion should be such as to restrict the relative rotation of the center electrode 5 relative to the locking member 29, and hence, there is imposed no specific limitation on the configuration of the electrode rotation restricting portion. Consequently, for example, as the electrode rotation restricting portion, a configuration may be adopted in which a groove is formed in a rear end face of the center electrode 5 so as to extend along the radial direction and by allowing the glass seal 8 to enter the groove, the relative rotation of the center electrode 5 to the locking member 29 is restricted. It should be noted that as shown in FIG. 6, the electrode rotation restricting portion (the projecting portion 5D) may be omitted.

Figure 7:
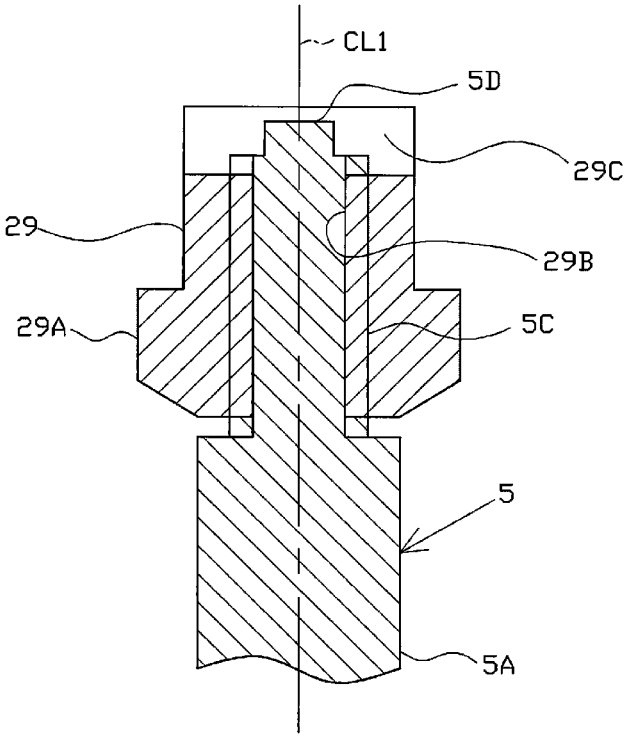
FIG. 7 is a sectional view showing the configuration of a center electrode and the like according to a third embodiment of the invention.

(c) In the embodiment, while the rear end portion (the projecting portion 5D) of the center electrode 5 projects further rearward towards the rear-end side in the direction of the axis CL1 than the rear end of the locking member 29, there is imposed no specific limitation on the relative positional relation between the rear end portion of the center electrode 5 and the rear end of the locking member 29. Consequently, for example, as shown in FIG. 7, a configuration may be adopted in which the rear end portion (the projecting portion 5D) of the center electrode 5 is positioned further forward towards the front-end side in the direction of the axis CL1 than the rear end of the locking member 29. In this case, too, in order to increase the securing properties of the center electrode 5 to the insulator 2, the projecting portion 5D is preferably brought into contact with the glass seal 8.

Figure 8:
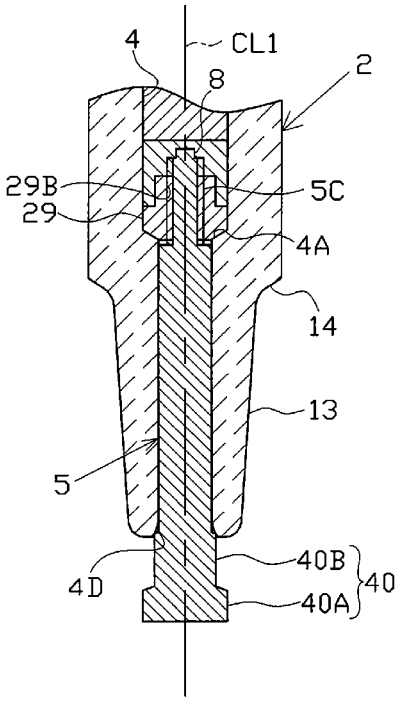
FIG. 8 is a partially sectional view showing the configuration of a center electrode and the like according to the second embodiment of the invention.

(d) Although no specific description is made in the embodiment, a configuration may be adopted in which a diametrically expanded portion 4D is provided at the front end of the insulator 2 where the axial hole 4 is diametrically expanded towards the front-end side in the direction of the axis CL1, so that the large diameter portion 5B is locked on the diametrically expanded portion 4D (the large diameter portion 5B is locked on the insulator 2). Consequently, for example, as shown in FIG. 8, a large diameter portion 40, which includes a first large diameter portion 40A and a second large diameter portion 40B of which outside diameters are larger than the minimum bore diameter of the axial hole 4, is provided at a portion of the center electrode 5 which is exposed from the front end of the insulator 2 and the large diameter portion 40 (the second large diameter portion 40B) is locked on the diametrically expanded portion 4D. In this case, the relative position of the center electrode 5 to the insulator 2 in the direction of the axis CL1 can be determined as a matter of course, thereby making it possible to prevent the offset of the center electrode 5 in the direction of the axis CL1 in a more ensured fashion. In addition, the large diameter portion 40 comes to be pressed in the direction of the axis CL1 by being brought into contact with the diametrically expanded portion 4D, and therefore, the center line of the center electrode 5 can be aligned with the axis CL1 with better accuracy. In FIG. 8, the first large diameter portion 40A and the second large diameter portion 40B have different outside diameters and the second large diameter portion 40B is locked on the diametrically expanded portion 4D. However, for example, a configuration may be adopted in which there is provided a large diameter portion having a constant outside diameter and the large diameter portion is locked on the diametrically expanded portion 4D. Namely, the large diameter portion should be such that its outside diameter is larger than the minimum bore diameter of the axial hole 4.

Figure 9:
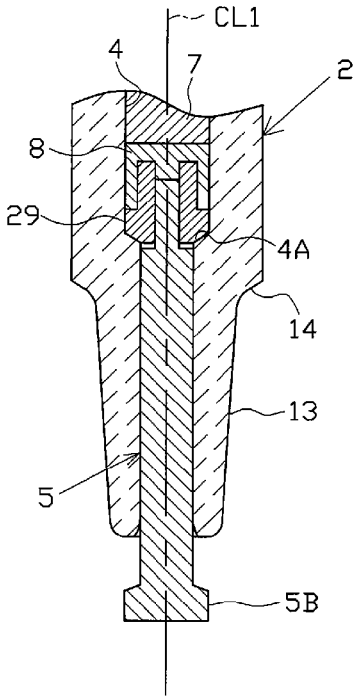
FIG. 9 is a partially enlarged sectional view illustrating a joining method of joining a center electrode and a locking member together according to the second embodiment of the invention.
Figure 10:
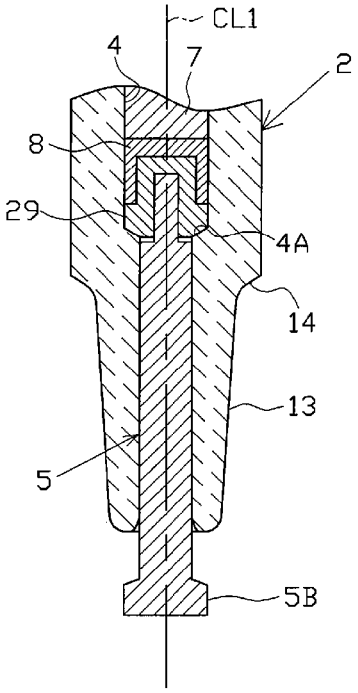
FIG. 10 is a partially enlarged sectional view illustrating a joining method of joining a center electrode and a locking member together according to the third embodiment of the invention.

(e) In the embodiment, the center electrode 5 and the locking member 29 are screw joined together, the joining method of joining these two members is not limited thereto. Consequently, for example, as shown in FIGS. 9 and 10, the center electrode 5 and the locking member 29 may be joined together through resistance welding. In addition, as shown in FIG. 9, the center electrode 5 may be brought into contact with the glass seal 8. Alternatively, as shown in FIG. 10, the center electrode 5 may not be brought into contact with the glass seal 8.

Figure 11:
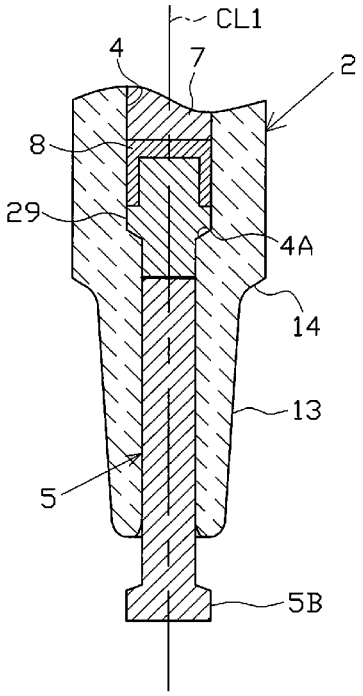
FIG. 11 is a partially enlarged sectional view illustrating a joining position where a center electrode and a locking member are joined together according to the second embodiment of the invention.

(f) In the embodiment, at least part of the joining portion between the center electrode 5 and the locking member 29 is positioned in the rear-end side axial hole 4C. In contrast with this, as shown in FIG. 11, the joining portion (that is, a portion indicated by a solid line in FIG. 11) between the center electrode 5 and the locking member 29 may be positioned in the front-end side axial hole 4B. Namely, the center electrode 5 and the locking member 29 should be joined together within the axial hole 4, and there is imposed no specific limitation on the joining position of both the members within the axial hole 4.

Figure 12:
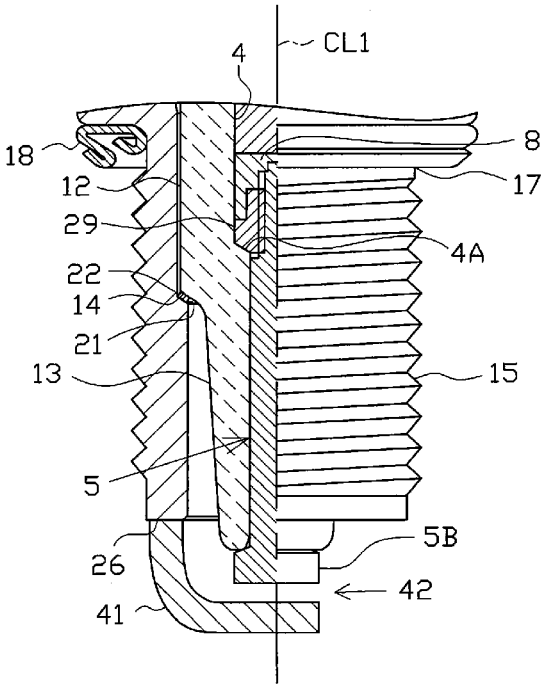
FIG. 12 is a partially cutaway front view showing the configuration of a ground electrode and a gap according to the second embodiment of the invention.
Figure 13:
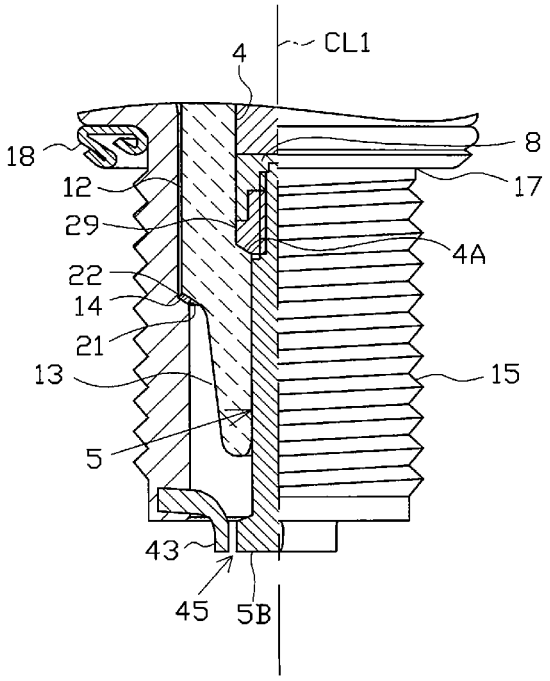
FIG. 13 is a partially cutaway front view showing the configuration of a ground electrode and a gap according to the third embodiment of the invention.
Figure 14:
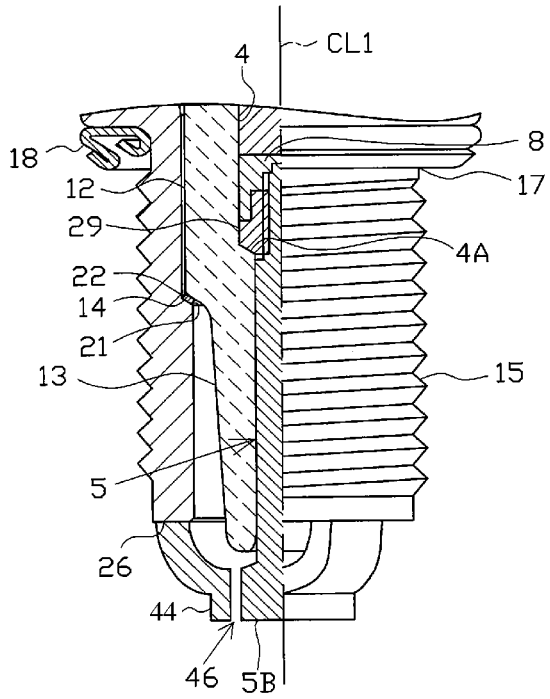
FIG. 14 is a partially cutaway front view showing the configuration of a ground electrode and a gap according to a fourth embodiment of the invention.

(g) In the embodiment, the plurality of ground electrodes 27 are provided, and the gaps 28 are defined between the side circumferential surface of the large diameter portion 5B and the distal end faces of the ground electrodes 27. In contrast with this, as shown in FIG. 12, there may be adopted a configuration in which only one ground electrode 41 is provided and a gap 42 is defined between a side surface of the ground electrode 41 and a front end face of a large diameter portion 5B. In this case, too, the volume of the center electrode 5 to be worn until a misfire takes place can be increased, thereby making it possible to realize the superior durability of the spark plug 1. In addition, as shown in FIGS. 13 and 14, a distal end portion of a ground electrode 43 (44) may be bent so as to extend in the direction of the axis CL1 so that a gap 45 (46) is defined between a side surface of the distal end portion of the ground electrode 43 (44) and a side circumferential surface of a large diameter portion 5B. As a result, the durability of the spark plug 1 can be increased further in association with the formation of the large diameter portion 5B on the center electrode 5.

(h) In the embodiment, while the glass seal 8 is described as functioning as the sealing member, for example, cement or talc may be used as the sealing member.

(i) In the embodiment, while the main body portion 5A and the large diameter portion 5B are described as being formed of the single metallic member, a configuration may be adopted in which a main body portion 5A and a large diameter portion 5B are formed of different metallic members and both portions are joined together to form a center electrode 5. It should be noted that both the metallic members are joined together before the center electrode 5 is inserted into the axial hole 4.

(j) In the embodiment, while the ground electrodes 27 are described as being joined to the front end portion of the metal shell 3, the invention can also be applied to a case where part of the metal shell (or part of a front end metal welded in advance to the metal shell) is skived to form a ground electrode or ground electrodes (for example, refer to JP-A-2006-236906).

(k) In the embodiment, while the tool engagement portion 19 has the hexagonal cross section, the shape of the tool engagement portion 19 is not limited thereto. Consequently, for example, the tool engagement portion 19 may have a Bi-HEX (a modified dodecagonal) shape [ISO 22977: 2005 (E)].

What is claimed is:

1. An electrode-attached insulator comprising:

an insulator provided with an axial hole which extends in the direction of an axis, the insulator having a diametrically expanded portion where the axial hole is diametrically expanded towards the front-end side in the direction of the axis at the front end thereof; and a center electrode is disposed in the axial hole on a front-end side of the axial hole wherein a front end portion is exposed from a front end of the insulator, said center electrode having a large diameter portion, said large diameter portion having an outside diameter that is larger than a minimum bore diameter of the axial hole and being disposed at a portion of the center electrode which is exposed from the front end of the insulator, and a locking member having a collar portion adapted to be locked on a step portion formed on an inner circumferential surface of the axial hole, wherein the center electrode and the locking member are joined together within the axial hole, and the large diameter portion is locked on the diametrically expanded portion, and wherein a distance L, that extends from a front end of the step portion to the front end of the insulator along the axis CL1, is equal to or larger than 15 mm.

2. The electrode-attached insulator according to claim 1, wherein the axial hole includes:

a front-end side axial hole which is positioned further forward towards the front-end side in the direction of the axis than the step portion; and a rear-end side axial hole that lies adjacent to a rear-end side of the front-end side axial hole in the direction of the axis and of which a bore diameter is larger than a bore diameter of the front-end side axial hole, and at least part of a joining portion between the center electrode and the locking member is positioned in the rear-end side axial hole.

3. The electrode-attached insulator according to claim 1, wherein a sealing member which fixes the insulator and the locking member together is provided in the axial hole, and wherein the center electrode is in contact with the sealing member.

4. The electrode-attached insulator according to claim 3, wherein the sealing member is a glass seal containing a glass component.

5. The electrode-attached insulator according to claim 1, wherein the large diameter portion is in contact with the insulator.

6. The electrode-attached insulator according to claim 1, wherein the center electrode and the locking member are screw joined together.

7. The electrode-attached insulator according to claim 6, wherein an electrode rotation restricting portion for restricting its relative rotation to the locking member is provided at a rear end portion of the center electrode.

8. The electrode-attached insulator according to claim 1, wherein a locking member rotation restricting portion for restricting its relative rotation to the insulator is provided on the locking member.

9. The electrode-attached insulator according to claim 1, wherein a sealing member for fixing the insulator and the locking member together is provided in the axial hole, and wherein the rear end portion of the center electrode projects further rearward towards the rear-end side in the direction of the axis than a rear end of the locking member to thereby be in contact with the sealing member.

10. A spark plug comprising:

the electrode-attached insulator according to claim 1;

a cylindrical metal shell provided on an outer circumference of the electrode-attached insulator; and a ground electrode configured to define a gap between the center electrode and itself.

11. The spark plug according to claim 10, wherein the gap is defined between a side circumferential surface of the large diameter portion and the ground electrode.

* * * * *